US009970662B2

(12) United States Patent
Cadima

(10) Patent No.: US 9,970,662 B2
(45) Date of Patent: May 15, 2018

(54) COOKTOP APPLIANCE

(71) Applicant: General Electric Company, Schenectady, NY (US)

(72) Inventor: Paul Bryan Cadima, Prospect, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 375 days.

(21) Appl. No.: 14/940,620

(22) Filed: Nov. 13, 2015

(65) Prior Publication Data

US 2017/0138605 A1 May 18, 2017

(51) Int. Cl.

| | |
|---|---|
| ***F24C 3/08*** | (2006.01) |
| ***F24C 15/10*** | (2006.01) |
| ***F23D 14/84*** | (2006.01) |
| ***F24C 3/00*** | (2006.01) |
| ***F23D 14/04*** | (2006.01) |

(52) U.S. Cl.

CPC ..... *F24C 3/08* (2013.01); *F23D 14/04* (2013.01); *F23D 14/84* (2013.01); *F24C 3/002* (2013.01); *F24C 15/107* (2013.01)

(58) Field of Classification Search

CPC ..... F24C 15/10; F24C 15/107

See application file for complete search history.

(56) References Cited

U.S. PATENT DOCUMENTS

| | | | |
|---|---|---|---|
| 5,295,476 | A | 3/1994 | Herbert |
| 7,881,593 | B2 | 2/2011 | Grassi et al. |
| 2010/0005979 | A1 | 1/2010 | Inzaghi |
| 2014/0246009 | A1 | 9/2014 | Tisselli et al. |
| 2014/0251305 | A1 | 9/2014 | Rasi |

FOREIGN PATENT DOCUMENTS

WO WO 2013/017986 A2 2/2013

*Primary Examiner* — David J Laux

(74) *Attorney, Agent, or Firm* — Dority & Manning, P.A.

(57) ABSTRACT

A cooktop appliance includes a gas burner assembly positioned on a panel of the cooktop appliance at a top surface of the panel. The gas burner assembly includes a grate configured for supporting a cooking utensil. The grate defines an internal fuel passage. The internal fuel passage of the grate extends to a burner such that fuel is directed to the burner via the internal fuel passage of the grate.

20 Claims, 6 Drawing Sheets

COOKTOP APPLIANCE

FIELD OF THE INVENTION

The present subject matter relates generally to cooktop appliances, such as gas cooktop appliance with burners.

BACKGROUND OF THE INVENTION

Generally, gas cooktop appliances include a plurality of gas burners mounted to a top surface of the appliance. During use of the cooktop, spills and overflows can lead to food particles accumulating on the top surface of the cooktop. Such food particles can collect beneath the gas burners and be difficult to clean.

Oven appliance users frequently cite difficulty cleaning beneath the gas burners as a complaint about modern cooktops. However, cleaning below gas burners on modern cooktops is difficult for a variety of reasons. For example, gas burners that are fastened to the cooktops generally include cracks at assembly interfaces that tend to accumulate food particles. As another example, gas burners that are removable from the cooktops by a user of the cooktop for cleaning generally include holes, supporting geometry and fasteners that are difficult to clean around. In addition, gas burners positioned coincident to top surfaces of associated cooktops inherently heat the top surfaces of the cooktops. The hot top surface of the cooktop can burn food particles, and burnt food particles on the cooktop can be particularly difficult to clean.

Accordingly, a cooktop appliance with features for facilitating cleaning below a burner of the cooktop appliance would be useful. In addition, a cooktop appliance with features for limiting heat transfer from a burner of the cooktop appliance to a top panel of the cooktop appliance would be useful.

BRIEF DESCRIPTION OF THE INVENTION

The present subject matter provides a cooktop appliance. The cooktop appliance includes a gas burner assembly positioned on a panel of the cooktop appliance at a top surface of the panel. The gas burner assembly includes a grate configured for supporting a cooking utensil. The grate defines an internal fuel passage. The internal fuel passage of the grate extends to a burner such that fuel is directed to the burner via the internal fuel passage of the grate. Additional aspects and advantages of the invention will be set forth in part in the following description, or may be apparent from the description, or may be learned through practice of the invention.

In a first exemplary embodiment, a cooktop appliance is provided. The cooktop appliance includes a panel having a top surface and a bottom surface. A fuel orifice is mounted to the panel adjacent the bottom surface of the panel. A gas burner assembly is positioned on the panel at the top surface of the panel. The gas burner assembly includes a grate configured for supporting a cooking utensil. The grate defines an internal fuel passage. A burner defines a plurality of flame ports. The burner is mounted to the grate such that the burner is suspended above the top surface of the panel. The internal fuel passage of the grate extends to the burner such that fuel from the fuel orifice is directed to the burner via the internal fuel passage of the grate.

In a second exemplary embodiment, a cooktop appliance is provided. The cooktop appliance includes a panel having a top surface. A gas burner assembly is positioned on the panel at the top surface of the panel. The gas burner assembly includes a grate configured for supporting a cooking utensil. The grate defines an internal fuel passage. An inlet of the internal fuel passage is positioned proximate an outer portion of the grate. An outlet of the internal fuel passage is positioned proximate a central portion of the grate. A burner defines a plurality of flame ports. The internal fuel passage of the grate extends to the burner such that a fuel chamber of the burner is contiguous with the outlet of the internal fuel passage.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
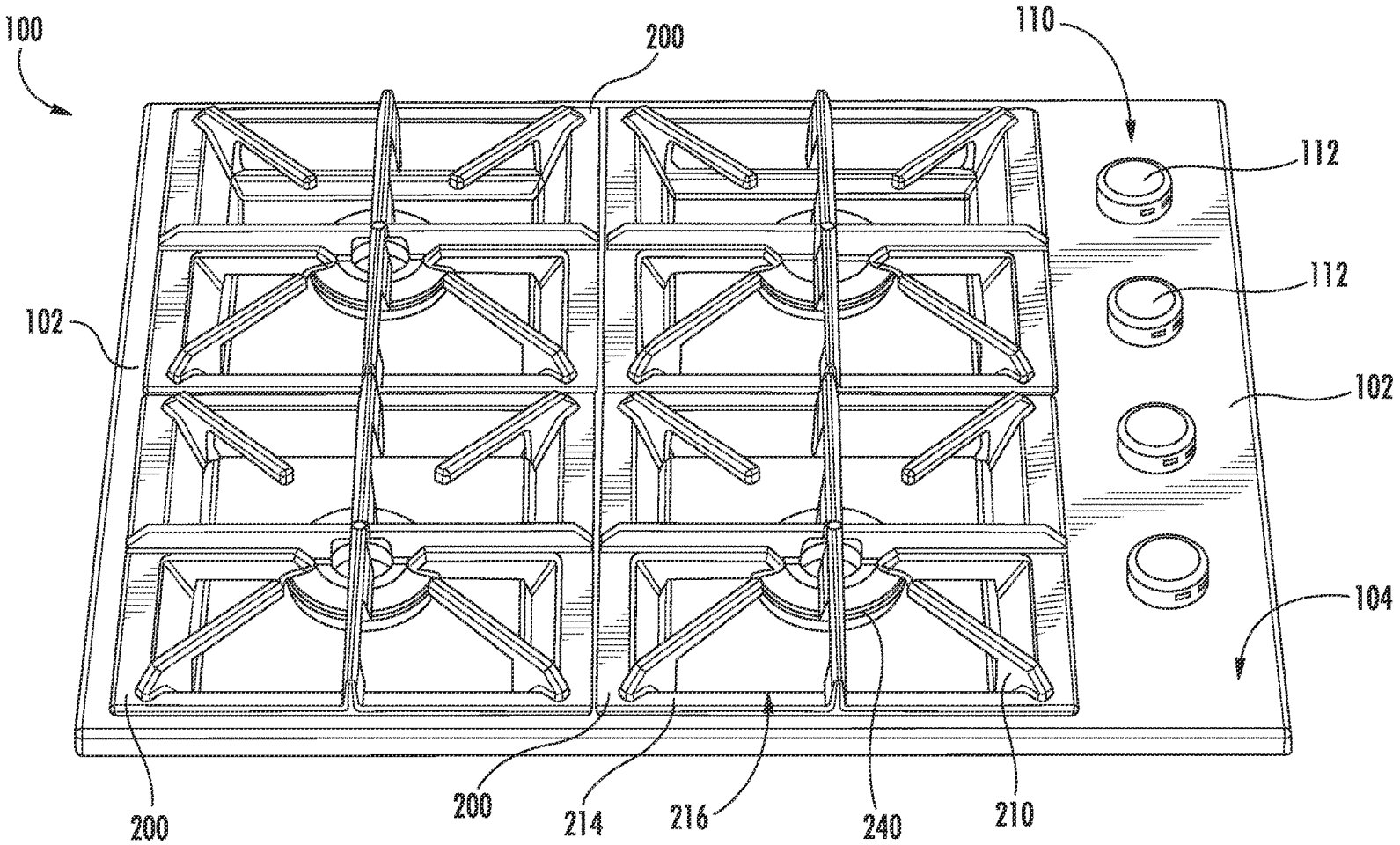
FIG. 1 provides a top, perspective view of a cooktop appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 illustrates an exemplary embodiment of a cooktop appliance 100 as may be employed with the present subject matter. Cooktop appliance 100 includes a panel 102, e.g., a top panel. By way of example, panel 102 may be constructed of enameled steel, stainless steel, glass, ceramics and combinations thereof.

For cooktop appliance 100, a utensil holding food and/or cooking liquids (e.g., oil, water, etc.) may be placed onto gas burner assemblies 200 at a location of any of gas burner assemblies 200. Gas burner assemblies 200 can be configured in various sizes so as to provide e.g., for the receipt of cooking utensils (i.e., pots, pans, etc.) of various sizes and configurations and to provide different heat inputs for such cooking utensils. Gas burner assemblies 200 are supported on a top surface 104 of panel 102, as discussed in greater detail below. Gas burner assemblies 200 provide thermal energy to cooking utensils above panel 102.

A user interface panel 110 is located within convenient reach of a user of the cooktop appliance 100. For this exemplary embodiment, user interface panel 110 includes knobs 112 that are each associated with one of gas burner assemblies 200. Knobs 112 allow the user to activate each burner assembly and determine the amount of heat input provided by each gas burner assemblies 200 to a cooking utensil located thereon. User interface panel 110 may also be provided with one or more graphical display devices that deliver certain information to the user such as e.g., whether a particular burner assembly is activated and/or the level at which the burner assembly is set.

Although shown with knobs 112, it should be understood that knobs 112 and the configuration of cooktop appliance 100 shown in FIG. 1 is provided by way of example only. More specifically, user interface panel 110 may include various input components, such as one or more of a variety of touch-type controls, electrical, mechanical or electromechanical input devices including rotary dials, push buttons, and touch pads. User interface panel 110 may include other display components, such as a digital or analog display device designed to provide operational feedback to a user.

Cooktop appliance 100 shown in FIG. 1 illustrates an exemplary embodiment of the present subject matter. Thus, although described in the context of cooktop appliance 100, the present subject matter may be used in cooktop appliances having other configurations, e.g., a cooktop appliance with one, two, or more additional burner assemblies. Similarly, the present subject matter may be used in cooktop appliances that include an oven, i.e., range appliances.

Figure 2:
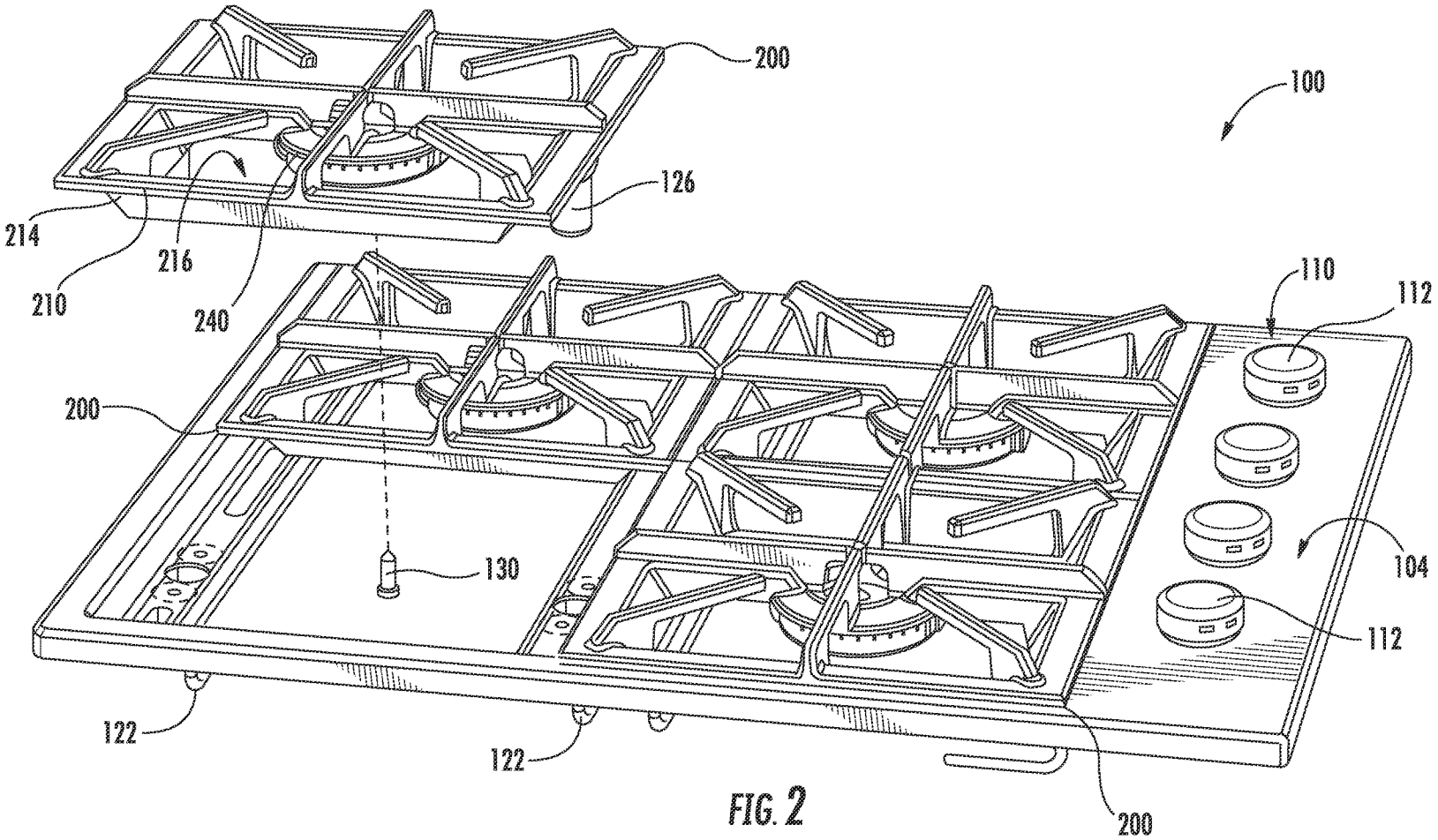
FIG. 2 provides another top, perspective view of the exemplary cooktop appliance of FIG. 1 with a gas burner assembly of the exemplary cooktop appliance shown removed from a panel of the exemplary cooktop appliance.

FIG. 2 provides another top, perspective view of cooktop appliance 100 with a gas burner assembly 200 of cooktop appliance 100 shown removed from panel 102 of cooktop appliance 100. As may be seen in FIG. 2, gas burner assembly 200 is removable from panel 102 of cooktop appliance 100. In certain exemplary embodiments, no mechanical fastening connects gas burner assembly 200 to panel 102. Thus, gas burner assembly 200 may not be fastened to panel 102, and a user may simply lift gas burner assembly 200 upwardly to remove gas burner assembly 200 from panel 102, as shown in FIG. 2. In such a manner, top surface 104 of panel 102 below gas burner assembly 200 may be easily accessible and cleanable.

Figure 3:
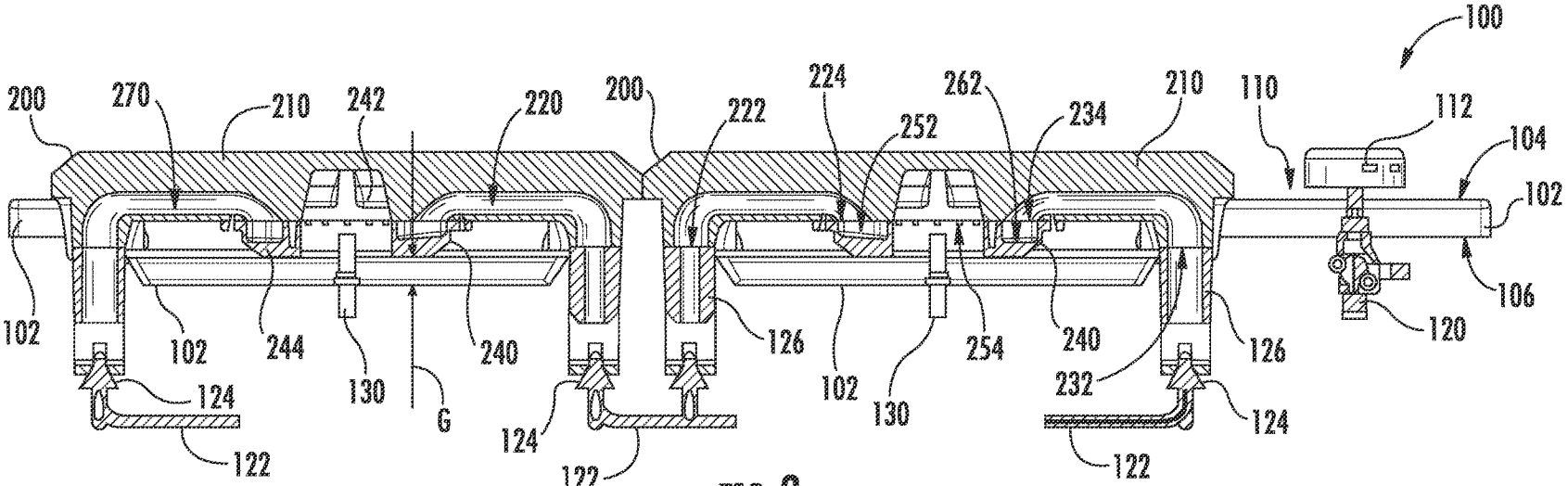
FIG. 3 provides a front, section view of the exemplary cooktop appliance of FIG. 1.

FIG. 3 provides a front, section view of cooktop appliance 100. As shown in FIG. 3, cooktop appliance 100 includes control valves 120, fuel lines 122 and fuel orifices 124. Control valves 120 may be mounted to panel 102 at a bottom surface 106 of panel 102. Fuel lines 122 and fuel orifices 124 may also be positioned below panel 120, e.g., at or adjacent bottom surface 106 of panel 102.

Control valves 120 are each coupled to a respective one of knobs 112. Thus, a user may adjust control valves 120 with knobs 112. Control valves 120 are configured for regulating fuel flow to gas burner assemblies 200. For example, control valves 120 block fuel flow to gas burner assemblies 200 when control valves 120 are closed. Conversely, control valves 120 permit fuel flow to gas burner assemblies 200 when control valves 120 are open. A user may selectively adjust control valves 120 between the open and closed configurations with knobs 112 in order to regulate fuel flow to gas burner assemblies 200.

Fuel lines 122 extend between control valves 120 and fuel orifices 124. Thus, control valves 120 and fuel orifices 124 may be coupled to fuel lines 122. When control valves 120 are open, fuel, such as propane or natural gas, may flow through fuel lines 122 to fuel orifices 124. From fuel orifices 124, the fuel may flow into gas burner assemblies 200 where the fuel may be combusted, as discussed in greater detail below.

Between fuel orifices 124 and gas burner assemblies 200, fuel from fuel orifices 124 may entrain and mix with air. Cooktop appliance 100 includes features for assisting mixing of air and fuel as the fuel enters gas burner assemblies 200. In particular, cooktop appliance 100 includes Venturi mixers 126 that receive the fuel and air and facilitate fluid mixing of the fuel and air. For example, Venturi mixers 126 may be tapered such that a pressure of the fuel and air decreases while a velocity of the fuel and air increases. Downstream of Venturi mixers 126, the pressure of the fuel and air may increase while the velocity of the fuel and air decreases to further assist fluid mixing between the fuel and air entering gas burner assemblies 200.

Figure 4:
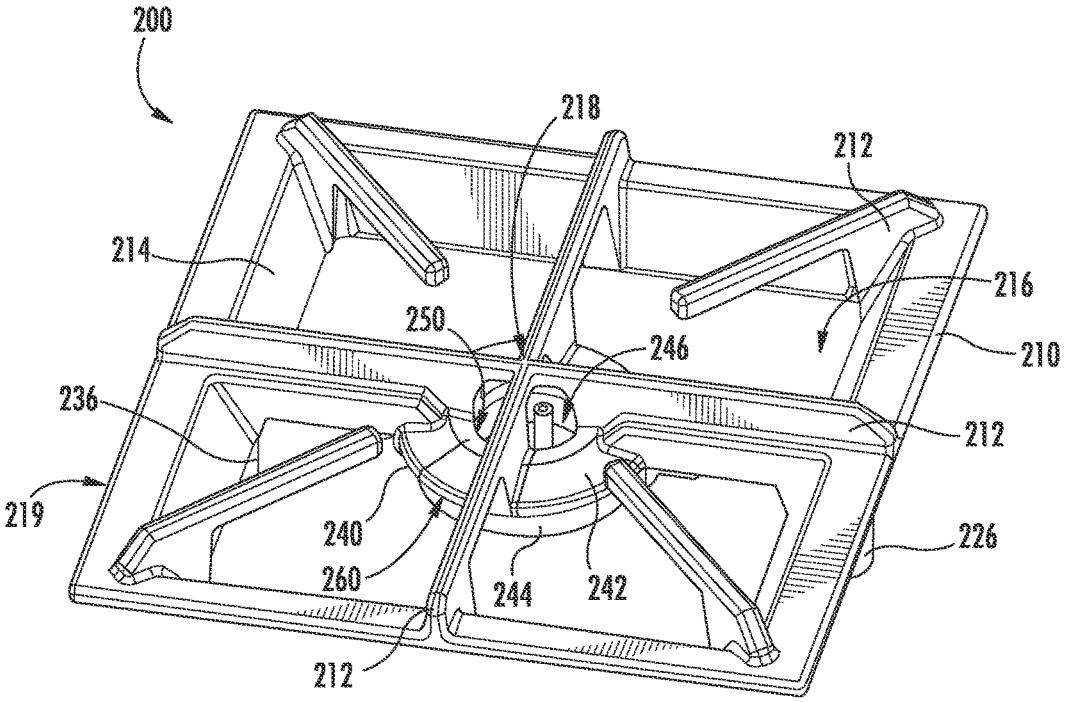
FIG. 4 provides a top, perspective view of the gas burner assembly of the exemplary cooktop appliance of FIG. 1.
Figure 5:
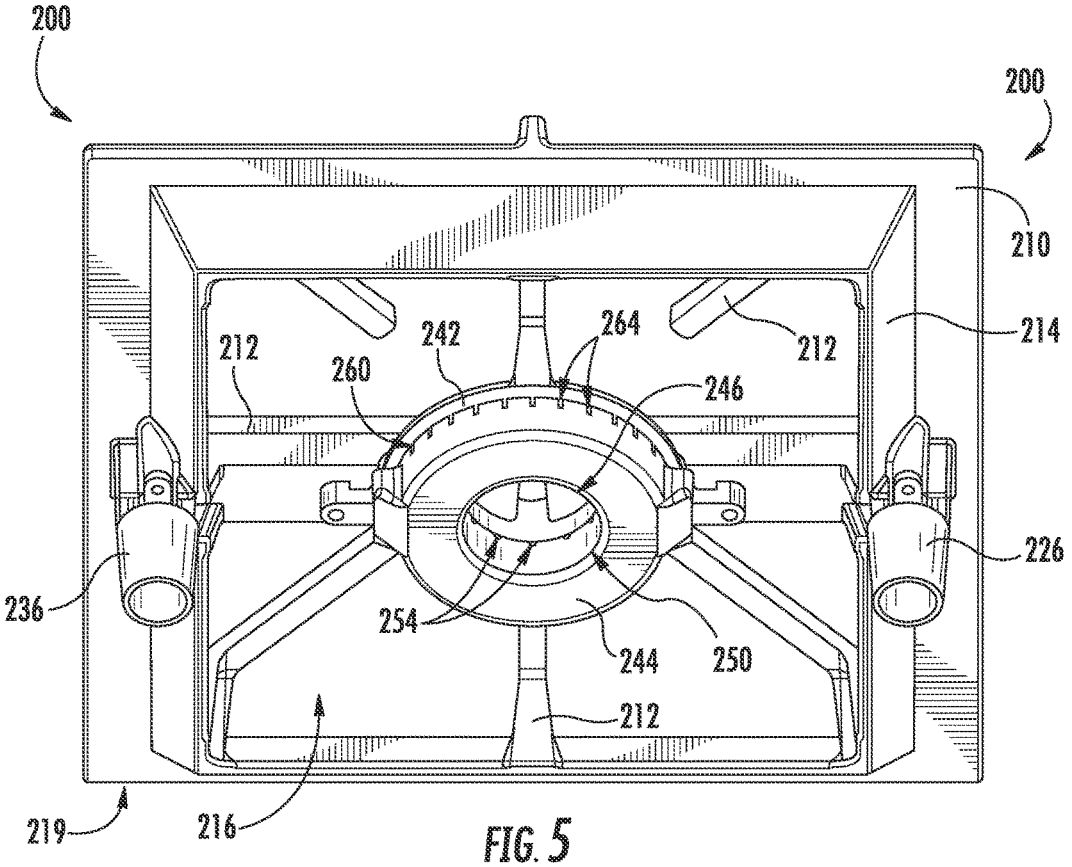
FIG. 5 provides a bottom, perspective view of the gas burner assembly of the exemplary cooktop appliance of FIG. 1.
Figure 6:
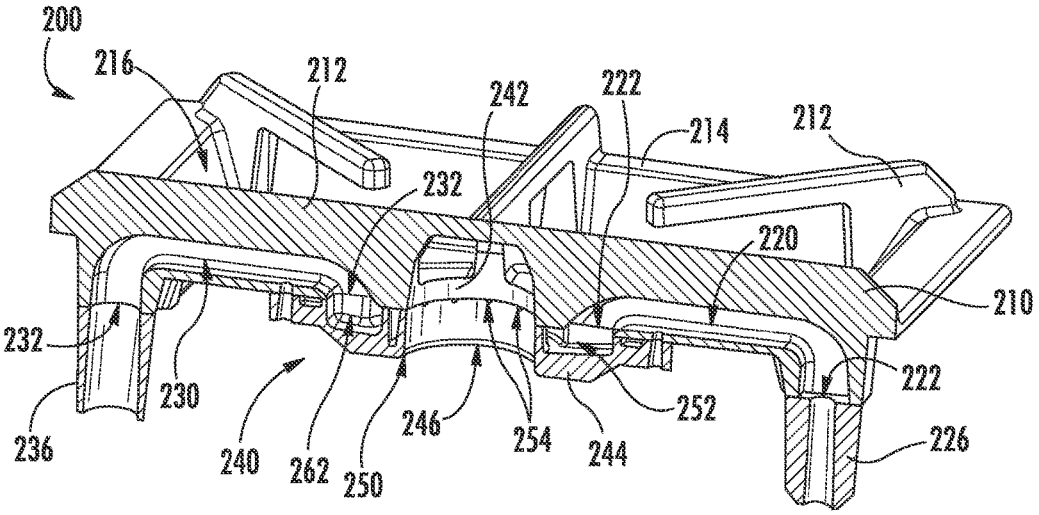
FIG. 6 provides a section view of the gas burner assembly of the exemplary cooktop appliance of FIG. 1.
Figure 7:
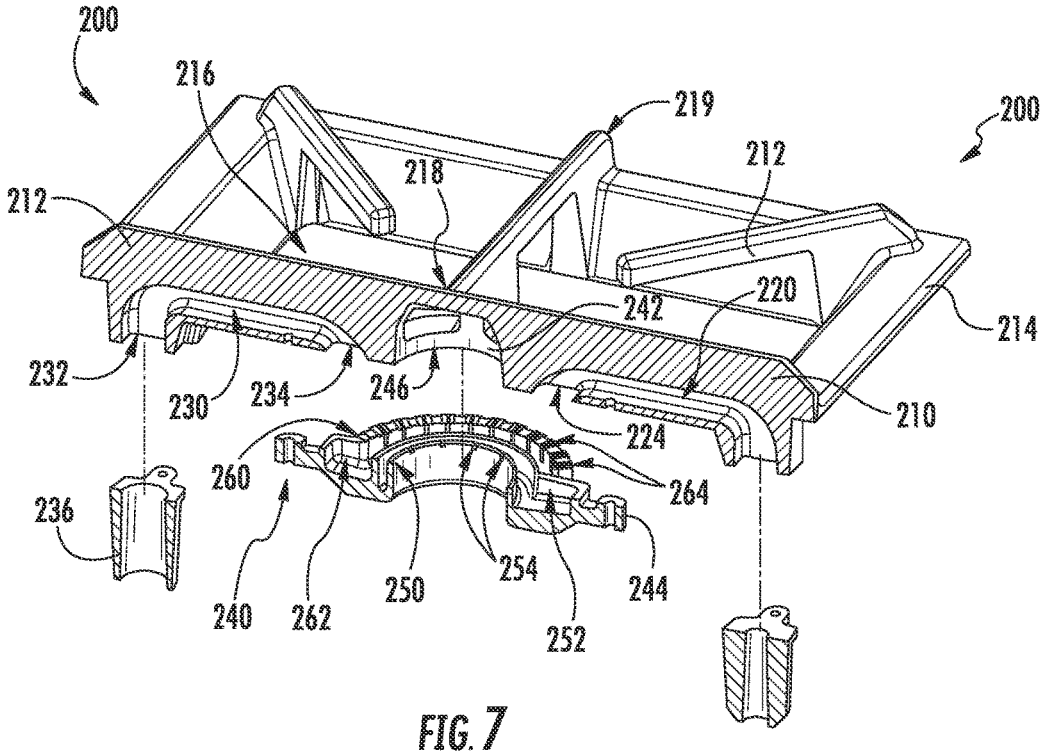
FIG. 7 provides an exploded, section view of the gas burner assembly of the exemplary cooktop appliance of FIG. 1.

FIG. 4 provides a top, perspective view of one of gas burner assemblies 200. FIG. 5 provides a bottom, perspective view of gas burner assembly 200. FIG. 6 provides a section view of gas burner assembly 200. FIG. 7 provides an exploded, section view of gas burner assembly 200. Various features of gas burner assembly 200 are discussed in greater detail below in the context of FIGS. 4-7.

As may be seen in FIGS. 4-7, gas burner assembly 200 includes a grate 210 and a burner 240. Grate 210 is configured for supporting a cooking utensil, such as a pot, pan, etc. For example, grate 210 includes a plurality of elongated members 212, e.g., formed of cast metal, such as cast iron. The cooking utensil may be placed on the elongated members 212 of grate 210 such that the cooking utensil rests on an upper surface of elongated members 212. Elongated members 212 of grate 210 may include an outer frame 214 that extends around or defines a perimeter of grate 210 and/or gas burner assembly 200. Thus, outer frame 214 may be positioned at an outer portion 219 of grate 210. Grate 210 may rest on panel 102 at outer frame 214 of grate 200. Thus, a bottom surface of outer frame 214 may rest on top surface 104 of panel 102. As shown in FIG. 4, outer frame 214 of grate 210 may be square or rectangular in certain exemplary embodiments. Within outer frame 214, elongated members 212 may define an inner passage 216 that extends vertically through grate 210. Thus, fluid, such as air, may flow through grate 210 via inner passage 216.

As may be seen in FIGS. 6 and 7, burner 240 may be positioned at a central portion 218 of grate 210. Thus, burner 240 may be positioned at or within inner passage 216 of grate 210, e.g., such that air within inner passage 216 of grate 210 flows by, around or through burner 240. Burner 240 may include a cap 242 and a base 244. Cap 242 of burner 240 may be mounted to grate 210. In particular, cap 242 may be integrally formed with grate 210, e.g., such that grate 210 and cap 242 of burner 240 are formed of or with a common piece of material. For example, grate 210 and cap 242 of burner 240 may be cast as a single, continuous piece of metal, such as cast iron. Base 244 of burner 240 is mounted to cap 242 of burner 240, e.g., with fasteners, such that base 244 and cap 242 of burner 240 form flame ports of burner 240, as discussed in greater detail below. Thus, cap 242 of burner 240 and base 244 of burner 240 may be separate pieces of material, such as cast metal, that are mounted to each other to form burner 240.

Figure 8:
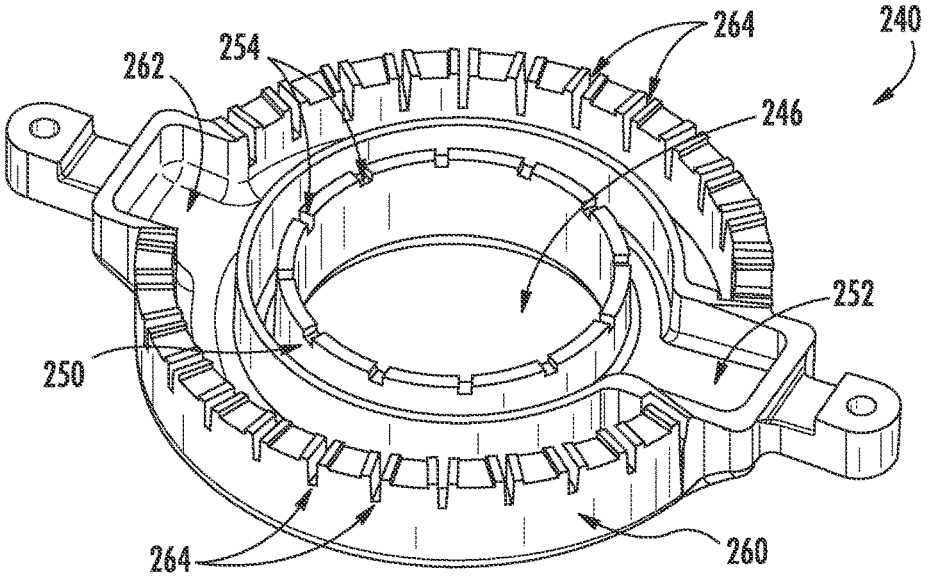
FIG. 8 provides a perspective view of a base of the gas burner assembly of FIG. 7.

FIG. 8 provides a perspective view of base 244 of burner 240. As shown in FIG. 8, burner 240 may be a multi-ring burner, in certain exemplary embodiments. Thus, burner 240 includes an inner burner ring 250 and an outer burner ring 260. The inner and outer burner rings 250, 260 may be concentrically positioned, e.g., such that outer burner ring 260 extends around inner burner ring 250. Inner burner ring 250 has a fuel chamber 252 and a plurality of flame ports 254. Similarly, outer burner ring 260 has a fuel chamber 262 and a plurality of flame ports 264. Fuel chamber 252 of inner burner ring 250 may be separated from fuel chamber 262 of outer burner ring 260 within burner 240, e.g., by a wall within burner 240. As shown in FIG. 5, cap 242 of burner 240 may define a passage 246 that allows air to flow through burner 240 at inner burner ring 250. Fuel chamber 252 of inner burner ring 250 and/or fuel chamber 262 of outer burner ring 260 may extend circumferentially around passage 246 within base 244.

Turning back to FIGS. 6 and 7, grate 210 includes features for supplying fuel to burner 240, e.g., to inner burner ring 250 and outer burner ring 260 of burner 240. In particular, grate 210 defines a first internal fuel passage 220 and a second internal fuel passage 230. First and second internal fuel passages 220, 230 are configured for directing fuel through grate 210 to burner 240. In particular, first internal fuel passage 220 is contiguous with fuel chamber 252 of inner burner ring 250. Thus, fuel from first internal fuel passage 220 may flow into fuel chamber 252 of inner burner ring 250 and exit fuel chamber 252 of inner burner ring 250 at flame ports 254 of inner burner ring 250 where such fuel may be combusted. Similarly, second internal fuel passage 230 is contiguous with fuel chamber 262 of outer burner ring 260. Thus, fuel from second internal fuel passage 230 may flow into fuel chamber 262 of outer burner ring 260 and exit fuel chamber 262 of outer burner ring 260 at flame ports 264 of outer burner ring 260 where such fuel may be combusted.

By mounting burner 240 to grate 210 and directing fuel through grate 210 to burner 240, cleaning panel 102 below gas burner assembly 200 may be facilitated. For example, as shown in FIG. 3, burner 240 may be mounted to grate 210 such that burner 240 is suspended above or spaced apart from top surface 104 of panel 102, e.g., by a gap G. With burner 240 separated from top surface 104 of panel 102, heat transfer between burner 240 and panel 102 may be limited. Thus, panel 102 may be cooler during operation of gas burner assembly 200 relative to burners that contact panel 102, and burning of spilled or overflowed food particles on top surface 104 of panel 102 may be reduced or limited. In addition, with burner 240 separated from top surface 104 of panel 102, access to panel 102 below burner 240 may be easier than compared to burners that are positioned on and mounted to panel 102, and a user may more easily reach below burner 240 to clean spills and overflows below burner 240. Further, by supplying fuel through grate 210, burner 240 need not receive fuel from directly below burner 240 through panel 102. Thus, panel 102 may have no holes, less holes and/or smaller holes directly below burner 240 relative to burners that are positioned on and mounted to panel 102 and receive fuel from directly below the burners. As shown in FIGS. 2 and 3, an igniter 130 may be mounted to panel 102 below burner 240, in certain exemplary embodiments.

As may be seen in FIGS. 3 and 6, at least a portion of first and second internal fuel passages 220, 230 may be positioned above flame ports of burner 240. In particular, at least a portion of first internal fuel passage 220 may be positioned above flame ports 254 of inner burner ring 250, and at least a portion of second internal fuel passage 230 may be positioned above flame ports 264 of outer burner ring 260. In such a manner, a vertical space occupied by gas burner assembly 200 may be reduced, and gas burner assembly 200 may have a compact vertical profile. In particular, utilizing first and second internal fuel passages 220, 230 to supply fuel to burner 240 assists with reducing a vertical height of gas burner assembly 200 relative to burners that deliver fuel to burners from below the flame ports due to the required spacing between the burners and a cooking utensil needed for proper combustion of fuel. In such a manner, cooktop appliance 100 may have a sleek, low profile that is preferred by certain consumers by delivering fuel to burner 240 through grate 210. As an example, a total vertical height of gas burner assembly 200 may be no greater than three inches in certain exemplary embodiments.

Turning to FIGS. 6 and 7, first internal fuel passage 220 extends between an inlet 222 and an outlet 224. Inlet 222 of first internal fuel passage 220 is positioned at or adjacent outer portion 219 of grate 210. Conversely, outlet 224 of first internal fuel passage 220 is positioned at or adjacent central portion 218 of grate 210. Thus, first internal fuel passage 220 may extend between outer portion 219 and central portion 218 of grate 210 within one of the elongated members 212 of grate 210. First Venturi mixer 226 is positioned at inlet 222 of first internal fuel passage 220. First Venturi mixer 226 may also be positioned above one of fuel orifices 124, as shown in FIG. 3. Thus, fuel from one of fuel orifices 124 may pass through first Venturi mixer 226 and enter first internal fuel passage 220 at inlet 222 of first internal fuel passage 220. Outlet 224 of first internal fuel passage 220 is contiguous with fuel chamber 252 of inner burner ring 250. Thus, fuel from first internal fuel passage 220 may flow into burner 240 via outlet 224 of first internal fuel passage 220.

Second internal fuel passage 230 also extends between an inlet 232 and an outlet 234. Inlet 232 of second internal fuel passage 230 is positioned at or adjacent outer portion 219 of grate 210. Conversely, outlet 234 of second internal fuel passage 230 is positioned at or adjacent central portion 218 of grate 210. Thus, second internal fuel passage 230 may extend between outer portion 219 and central portion 218 of grate 210 within one of the elongated members 212 of grate 210. Second Venturi mixer 236 is positioned at inlet 232 of second internal fuel passage 230. Second Venturi mixer 236 may also be positioned above one of fuel orifices 124, as shown in FIG. 3. Thus, fuel from one of fuel orifices 124 may pass through second Venturi mixer 236 and enter second internal fuel passage 230 at inlet 232 of second internal fuel passage 230. Outlet 234 of second internal fuel passage 230 is contiguous with fuel chamber 262 of outer burner ring 260. Thus, fuel from second internal fuel passage 230 may flow into burner 240 via outlet 234 of second internal fuel passage 230.

As shown in FIGS. 6 and 7, first and second Venturi mixers 226, 236 may be positioned opposite each other on gas burner assembly 200. In particular, burner 240 may be positioned between first and second Venturi mixers 226, 236. Thus, first and second internal fuel passages 220, 230 may also be positioned opposite each other on gas burner assembly 200, and burner 240 may be positioned between first and second internal fuel passages 220, 230. In particular, outlet 224 of first internal fuel passage 220 may be positioned opposite outlet 234 of second internal fuel passage 230 on burner 240.

Grate 210 may be constructed of or with any suitable material. For example, grate 210 may be constructed of or with a single piece of cast metal. In particular, grate 210 may be formed of cast iron with first and second internal fuel passages 220, 230 formed within grate 210 using disposable cores during the casting process. First and second Venturi mixers 226, 236 may also be integrally formed with grate 210 or may be separate components mounted, e.g., fastened, to grate 210.

Figure 9:
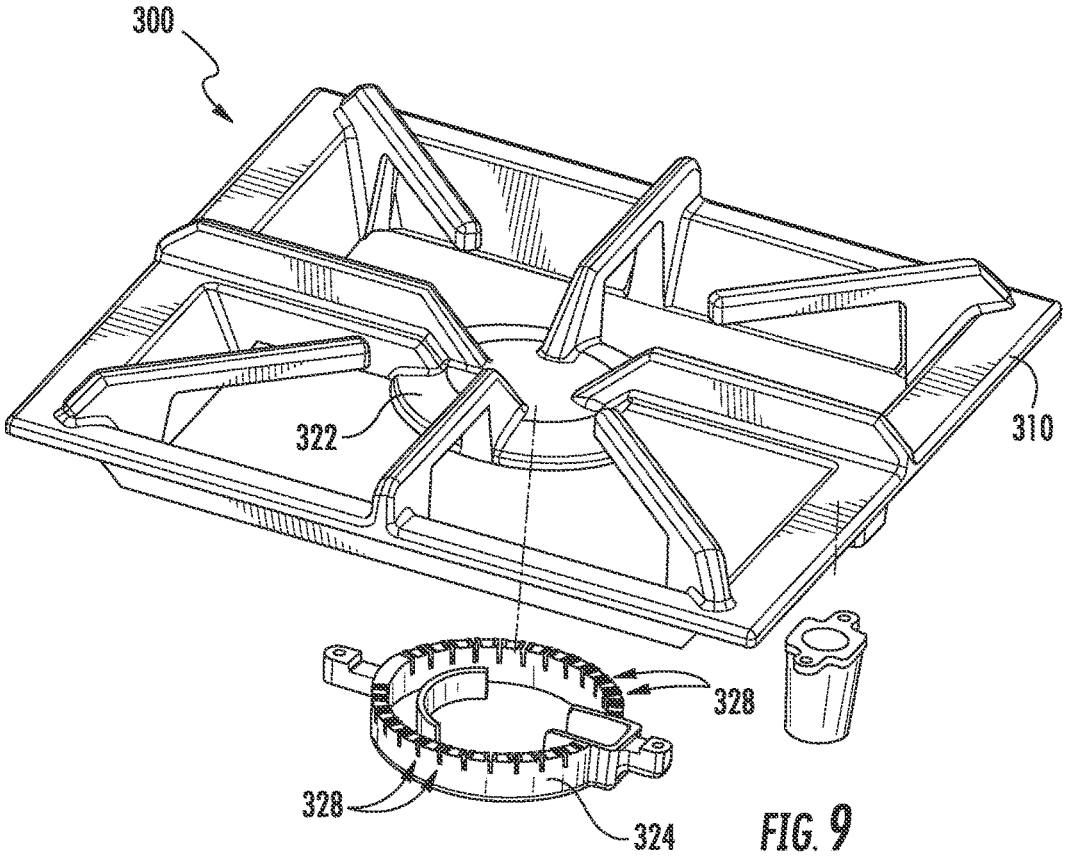
FIG. 9 provides an exploded, perspective view of a gas burner assembly according to another exemplary embodiment of the present subject matter.

FIG. 9 provides an exploded, perspective view of a gas burner assembly 300 according to another exemplary embodiment of the present subject matter. As may be seen in FIG. 9, gas burner assembly 300 includes a grate 310 and a burner 320 having a cap 322 and base 324. In contrast to burner 240 of gas burner assembly 200 (FIG. 4), burner 320 is a single ring burner. Thus, cap 322 and base 324 may define a single ring of flame ports 328, and grate 310 may define a single internal fuel passage that directs fuel into burner 320. In addition, cap 322 may be solid and not define an internal passage for air flow through burner 320 in gas burner assembly 300, e.g., because burner 320 is not a multi-ring burner.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A cooktop appliance, comprising:
- a panel having a top surface and a bottom surface;
- a fuel orifice mounted to the panel adjacent the bottom surface of the panel;
- a gas burner assembly positioned on the panel at the top surface of the panel, the gas burner assembly comprising
  - a grate configured for supporting a cooking utensil, the grate defining an internal fuel passage;
  - a burner defining a plurality of flame ports, the burner mounted to the grate such that the burner is suspended above the top surface of the panel, the internal fuel passage of the grate extending to the burner such that fuel from the fuel orifice is directed to the burner via the internal fuel passage of the grate.

2. The cooktop appliance of claim 1, wherein the burner comprises an inner burner ring and an outer burner ring, the flame ports of the plurality of flame ports comprising flame ports at the inner burner ring and flame ports at the outer burner ring, the internal fuel passage being a first internal fuel passage, the grate further defining a second internal fuel passage, the first internal fuel passage contiguous with the flame ports at the inner burner ring, the second internal fuel passage contiguous with the flame ports at the outer burner ring.

3. The cooktop appliance of claim 2, wherein the fuel orifice is a first fuel orifice and the cooktop appliance further comprises a second fuel orifice, the first internal fuel passage of the grate extending to the inner burner ring such that fuel from the first fuel orifice is directed to the inner burner ring via the first internal fuel passage of the grate, the second internal fuel passage of the grate extending to the outer burner ring such that fuel from the second fuel orifice is directed to the outer burner ring via the second internal fuel passage of the grate.

4. The cooktop appliance of claim 3, wherein the gas burner assembly further comprises a first Venturi mixer and a second Venturi mixer, the first Venturi mixer mounted to the grate at an inlet of the first internal fuel passage above the first fuel orifice, the second Venturi mixer mounted to the grate at an inlet of the second internal fuel passage above the second fuel orifice.

5. The cooktop appliance of claim 4, wherein the first and second Venturi mixers are positioned at opposite sides of the gas burner assembly.

6. The cooktop appliance of claim 4, wherein the first and second Venturi mixers are integrally formed with the grate.

7. The cooktop appliance of claim 1, wherein the burner comprises a cap and a base, the cap integrally formed with the grate, the base mounted to the cap such that the base and the cap form the plurality of flame ports.

8. The cooktop appliance of claim 1, further comprising an igniter mounted to the panel below the burner.

9. The cooktop appliance of claim 1, wherein the grate is a single piece of cast metal.

10. The cooktop appliance of claim 1, wherein at least a portion of the internal fuel passage is positioned above the flame ports of the plurality of flame ports.

11. A cooktop appliance, comprising:
- a panel having a top surface;
- a gas burner assembly positioned on the panel at the top surface of the panel, the gas burner assembly comprising
  - a grate configured for supporting a cooking utensil, the grate defining an internal fuel passage, an inlet of the internal fuel passage positioned proximate an outer portion of the grate, an outlet of the internal fuel passage positioned proximate a central portion of the grate;
  - a burner defining a plurality of flame ports, the internal fuel passage of the grate extending to the burner such that a fuel chamber of the burner is contiguous with the outlet of the internal fuel passage.

12. The cooktop appliance of claim 11, wherein the burner is mounted to the grate such that the burner is suspended above the top surface of the panel.

13. The cooktop appliance of claim 12, further comprising an igniter mounted to the panel below the burner.

14. The cooktop appliance of claim 11, wherein the burner comprises an inner burner ring and an outer burner ring, the flame ports of the plurality of flame ports comprising flame ports at the inner burner ring and flame ports at the outer burner ring, the internal fuel passage being a first internal fuel passage, the grate further defining a second internal fuel passage, the first internal fuel passage configured for supplying fuel to the flame ports at the inner burner ring, the second internal fuel passage configured for supplying fuel to the flame ports at the outer burner ring.

15. The cooktop appliance of claim 14, wherein the gas burner assembly further comprises a first Venturi mixer and a second Venturi mixer, the first Venturi mixer mounted to the grate at an inlet of the first internal fuel passage, the second Venturi mixer mounted to the grate at an inlet of the second internal fuel passage.

16. The cooktop appliance of claim 15, wherein the first and second Venturi mixers are positioned at opposite sides of the gas burner assembly.

17. The cooktop appliance of claim 15, wherein the first and second Venturi mixers are integrally formed with the grate.

18. The cooktop appliance of claim 11, wherein the burner comprises a cap and a base, the cap integrally formed with the grate, the base mounted to the cap such that the plurality of flame ports is formed between the base and the cap.

19. The cooktop appliance of claim 11, wherein the grate is a single piece of cast metal.

20. The cooktop appliance of claim 11, wherein at least a portion of the internal fuel passage between the inlet of the internal fuel passage and the outlet of the internal fuel passage is positioned above the flame ports of the plurality of flame ports.

* * * * *